US005190491A

United States Patent [19]

Connelly

[11] Patent Number: 5,190,491

[45] Date of Patent: Mar. 2, 1993

[54] ANIMATED PADDLE

[75] Inventor: Keith Connelly, Ithaca, N.Y.

[73] Assignee: I & K Trading Corporation, Vienna, Va.

[21] Appl. No.: 800,801

[22] Filed: Nov. 27, 1991

[51] Int. Cl.[5] ..... A63H 33/26

[52] U.S. Cl. ..... 446/242; 446/236; 446/485

[58] Field of Search ..... 446/47, 236, 242, 484, 446/485; 273/433, 460

[56] References Cited

U.S. PATENT DOCUMENTS

| | | | |
|---|---|---|---|
| 2,307,905 | 1/1943 | Ament | 446/236 X |
| 2,726,483 | 12/1955 | Hughes et al. | 446/242 |
| 2,739,419 | 3/1956 | Cleveland | 446/242 |
| 2,836,009 | 5/1958 | Wang | 446/242 |
| 2,841,922 | 7/1958 | Kolintzas | 446/242 |
| 3,037,322 | 6/1962 | Baumgartner, Jr. | 446/242 |
| 3,325,940 | 6/1967 | Davis | 446/242 |
| 4,004,499 | 8/1977 | Tocer | 446/242 |
| 4,570,924 | 2/1986 | Connelly | 446/485 X |
| 5,030,160 | 7/1991 | Klawitter | 446/242 |
| 5,073,139 | 12/1991 | Kassarich | 446/242 |

*Primary Examiner*—Robert A. Hafer
*Assistant Examiner*—Sam Rimell
*Attorney, Agent, or Firm*—Blum Kaplan

[57] ABSTRACT

An animated paddle includes a handle and a paddle rotationally mounted to the handle. The paddle includes a plurality of light emitting diodes. The light emitting diodes are selectively illuminated in accordance with a predetermined pattern. However, the light emitting diodes may be illuminated to transmit a message, such as a word, or they may be illuminated to produce designs, such as circles of sequentially greater and lesser size.

12 Claims, 5 Drawing Sheets

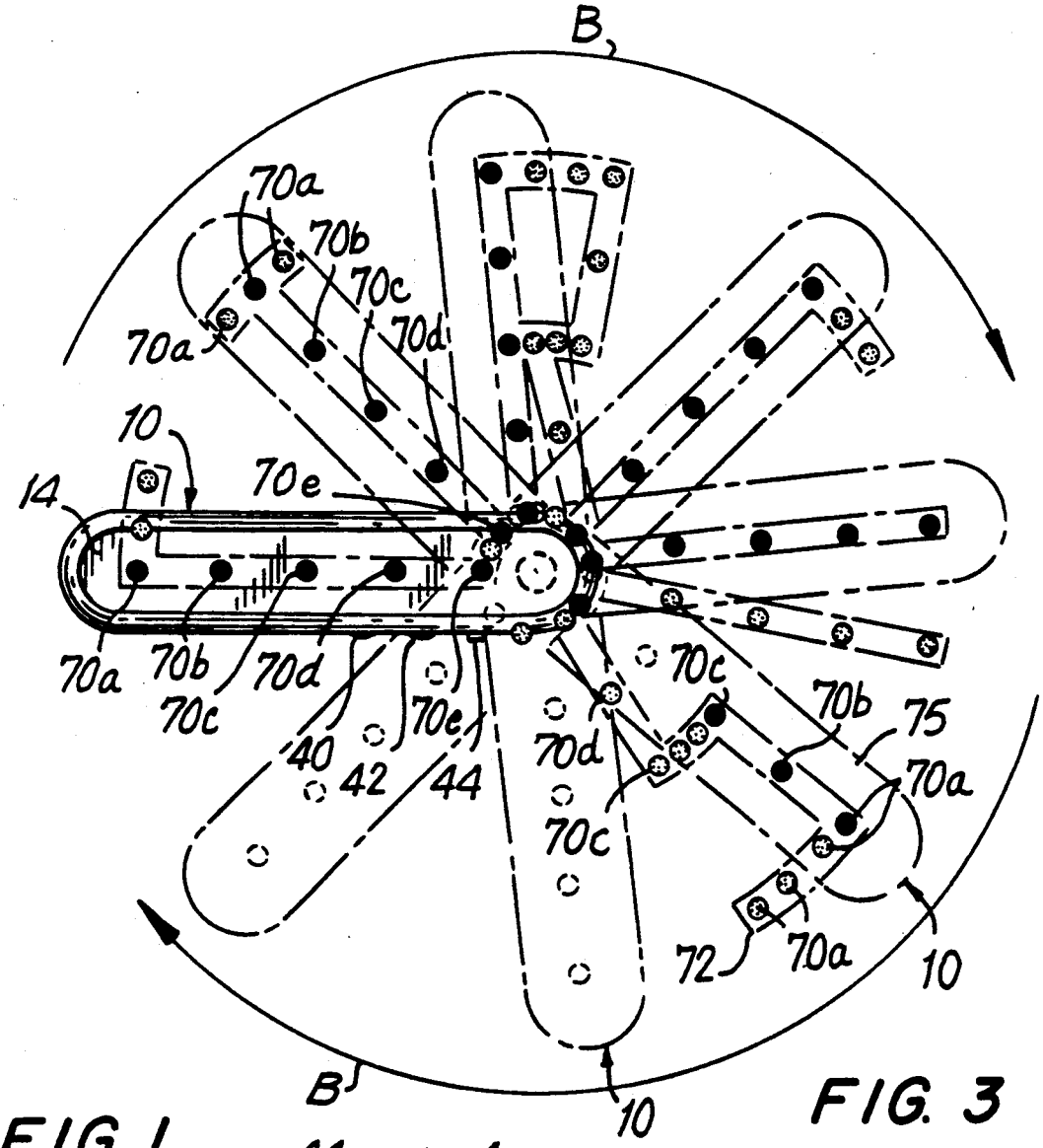
FIG. 3
FIG. 1
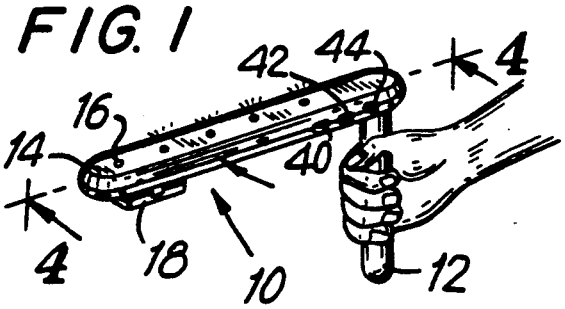

ANIMATED PADDLE

BACKGROUND OF THE INVENTION

This invention is directed to a toy paddle, and, in particular, to a toy paddle having a plurality of lights that selectively illuminate such that a message is spelled out or a design is created when the paddle is pivoted about its handle. This invention provides the user with enhanced play value over conventional non-animated paddles.

Conventional (non-animated) paddles are known in the art and are often provided with noise making capabilities. These paddles include a handle and a housing rotatably mounted on the handle. A noise generator which is activated by rotation of the handle is supported within the housing.

These paddles are often used during celebrations and joyous occasions. For example, conventional paddles are used at sporting events and festive gatherings such as New Year's Eve. The noise making capability of conventional paddles has made them useful for these joyous occasions.

However, the prior art paddles suffer from the disadvantage that since they provide only sound and no visual component, they only serve the function of creating noise. This noise can be slightly varied according to the speed with which the paddle is rotated. A noise making device providing substantially monotonal noise provides little play value to the user. Such noise making paddles are quickly discarded after the celebration for which they were intended. Accordingly, an animated toy paddle that provides enhanced play value by providing a toy that emits multicolored light, sound and a plurality of different designs and messages from a single paddle is desired.

SUMMARY OF THE INVENTION

Generally speaking, in accordance with the instant invention, an animated paddle is provided. The paddle includes a handle and a paddle body rotationally mounted to the handle. The paddle body includes a plurality of lights on its surface and houses a circuit for storing light illumination patterns. The lights are selectively illuminated in accordance with a preprogrammed pattern dictated by the circuit, so that a design or a message appears to be continuously displayed by the lights as the paddle is rotated.

Accordingly, it is an object of the instant invention to provide an improved paddle. Yet another object of the instant invention is to provide an improved toy paddle.

A further object of the instant invention is to provide an animated toy paddle which spells out a message when the paddle is rotated around the handle.

Another object of the instant invention is to provide an animated toy paddle that produces designs when rotated about the handle.

A still further object of the invention is to provide an animated toy paddle that enables a child to generate words and designs from a multiplicity of lights in a single line, providing distinct play value thereby.

Yet another object of the invention is to provide an animated toy paddle that appears to continuously generate multicolored light about a circle.

Still other objects and advantages of the invention will in part be obvious and will in part be apparent from the specification.

The invention accordingly comprises the features of construction, combination of elements and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description, taken in connection with the accompanying drawings, in which:

FIG. 1 is a perspective view of an animated paddle constructed in accordance with the invention in use;

FIG. 3 is a top elevational view of an animated paddle in use in accordance with the invention with lights and paddle bodies shown in phantom spelling out a message;

DETAILED DESCRIPTION OF THE PREFERRED EMBODIMENTS

Figure 2:
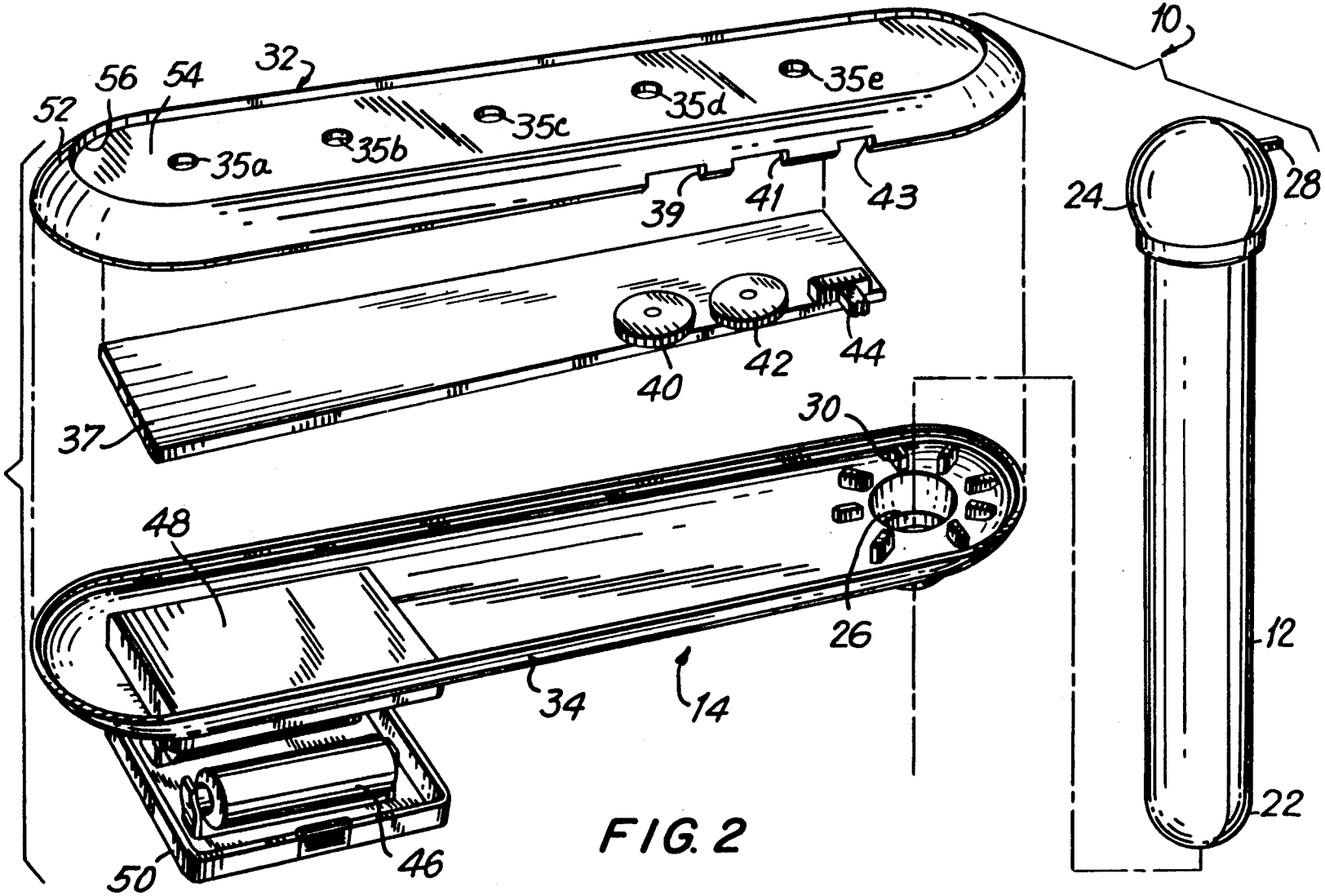
FIG. 2 is an exploded perspective view of an animated paddle constructed in accordance with the invention.

Reference is first made to FIGS. 1–5 in which an animated paddle, generally indicated as 10, constructed in accordance with the invention is depicted. Paddle 10 includes a handle assembly 12 and a paddle body 14. Paddle body 14 has an upper portion 32 and a lower portion 34. Paddle body 14 may be formed of a thermoplastic material such as K-resin or polypropylene. However, the invention is not limited to a paddle formed of thermoplastic material. Upper portion 32 of paddle 14 is formed with a plurality of bores 35*a*–35*e* dimensioned to receive lights 70*a*–70*e* therethrough. Upper portion 32 of paddle 14 is designed with cutout portions 39, 41 and 43 to receive switches 40, 42 and 44 respectively therein.

Furthermore, upper portion 32 of paddle 14 is formed with an outer shell 52 that is integrally formed to a flat recessed top plate 54 through an upstanding wall 56. Plate 54 is recessed within outer shell 52 such that lights 70*a*–70*e*, which are inserted through bores 35*a*–35*e*, are protected by outer shell 52 when paddle 14 is rotated about handle 12.

Lower portion 34 of paddle body 14 is formed with a socket 26. A plurality of spaced projections 30 extend about socket 26. Socket 26 is adapted to receive handle 12. A battery housing 48 is integrally formed with lower portion 34. A battery housing cover 50 is affixed to battery housing 48 by a snap fit. Batteries 46 for powering paddle 10 are placed in battery cover 50 which is then snap fit to housing 48. Cover 50 may be secured to housing 48 by other means, such as threads, or a hinge and lock clasp arrangement.

A printed circuit board 37 is disposed within paddle 14. Electronic components 60 are affixed to the lower surface 64 of printed circuit board 37. Components 60 fit easily within space 62 formed between upper portion 32 and lower portion 34. The circuit of printed circuit board 37 is electrically coupled between batteries 46 and lights 70a–70e which are mounted upon upper surface 66 of circuit board 37. Terminals 45, 47 mounted on cover 50 are coupled to positive pole 46a and negative pole 46b of battery 46, respectively couple battery 46 to printed circuit board 37. Switches 40, 42 control potentiometers mounted on printed circuit board 37 for controlling the operation modes of paddle 10, while switch 44 is an ON/OFF switch.

Figures 4, 5:
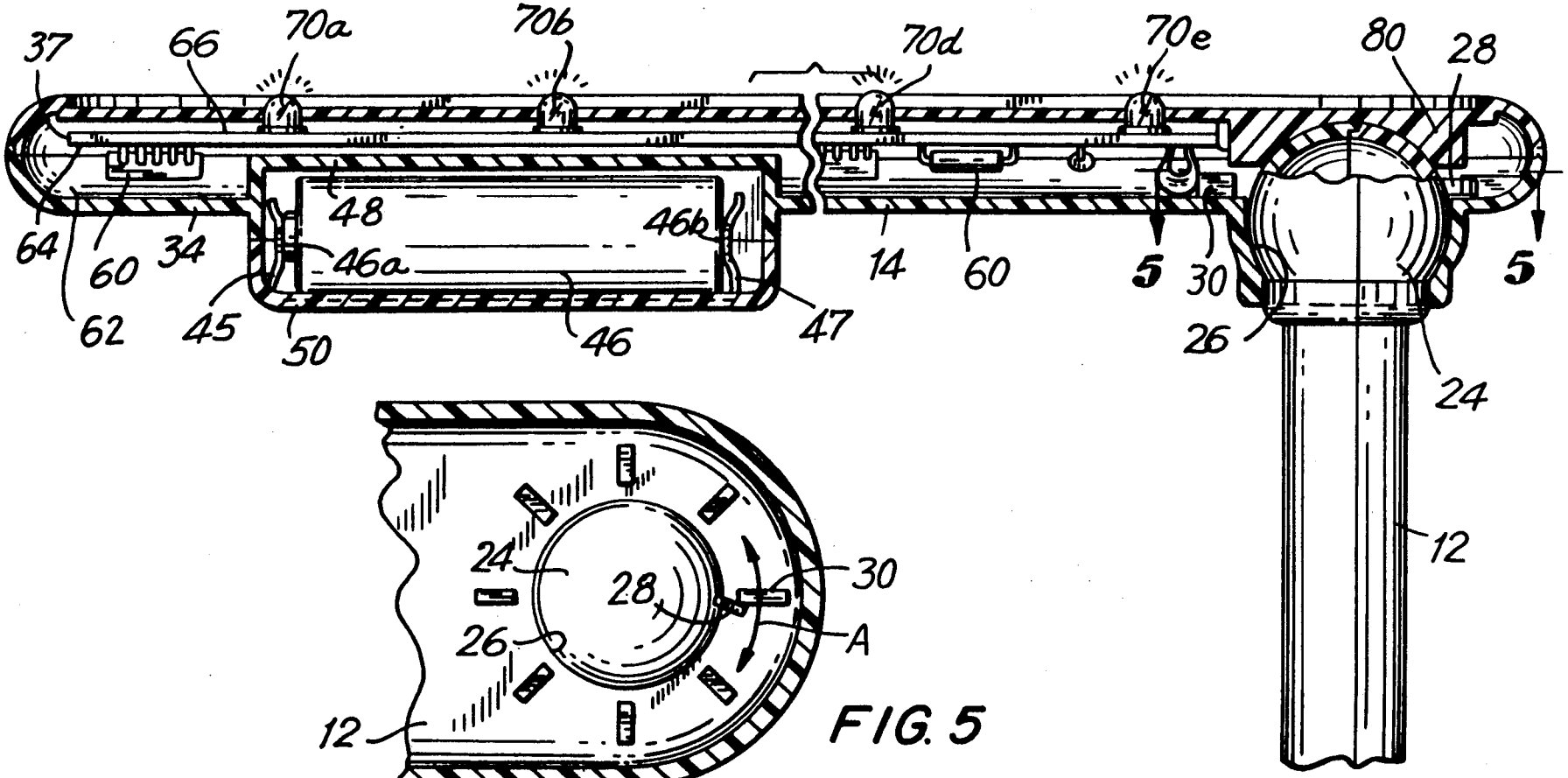
FIG. 4 is a sectional view taken along line 4—4 of FIG. 1.
FIG. 5 is a fragmentary sectional view of the intersection of the handle and paddle body taken along line 5—5 of FIG. 4.

Handle 12 includes a bottom portion 22 and a top ball portion 24. Ball 24 is rotationally mounted within socket 26 in a ball and socket manner (FIGS. 4, 5). Upper portion 32 is provided with a retaining member 80 adapted to receive ball 24 and bias ball 24 into socket 26. Ball 24 has a finger 28 projecting radially therefrom to contact projections 30 of paddle body 14 as paddle body 14 is rotated in the direction of arrow A relative to handle 12. Ball 24 is coupled to socket 26 such that paddle 14 is capable of rotating about ball 24 of handle 12. Finger 28 of ball 24 engages projections 30 and makes a "click" sound each time finger 28 contacts and moves past a projection 30.

Switch 44 is moveable between a first position and a second position. As will be discussed in connection with FIGS. 6, 7, when switch 44 is in the first position, no current flows through PC board 37 and lights 70a–70e do not illuminate so that paddle 10 is OFF. However, when switch 44 is in the second position, paddle 10 is ON, current flows through PC board 37 and lights 70a–70e become illuminated. The frequency with which lights 70a–70e turn ON and OFF (the illuminated state and non-illuminated state) is controlled by rotating switches 40, 42.

Lights 70a–70e are preferably light emitting diodes (LED). Further, in the preferred embodiment of this invention, the LED is a two color LED. A two color LED provides greater play value for the user by adding an extra dimension to the effect that may be created. Accordingly, not only the effect is varied, but the colors in the effect are varied also, such that a desired effect might be, for example, to form circles with the LEDs with a continuous change in the size of the circles formed as the paddle is rotated, with each concentric circle changing in color.

An LED is preferable to a common incandescent light source because an incandescent light source provides light by electric current traveling through a fine wire filament which causes the filament to heat up and glow. The glowing causes light to be emitted. Accordingly, the light stops after current stops flowing therethrough and the metallic filament cools down. Thus, there is neither a "discrete" turn ON of the light nor a "discrete" turn OFF of the light. This is due to the fact that at turn ON, the filament must first be heated to turn ON and at turn OFF, the filament must cool down before the glowing stops. Alternatively, a light emitting diode is either in an ON state or OFF state. When forming a message such as "circus" shown in FIG. 3, discrete ON/OFF and OFF/ON transitions are required.

Figure 6:
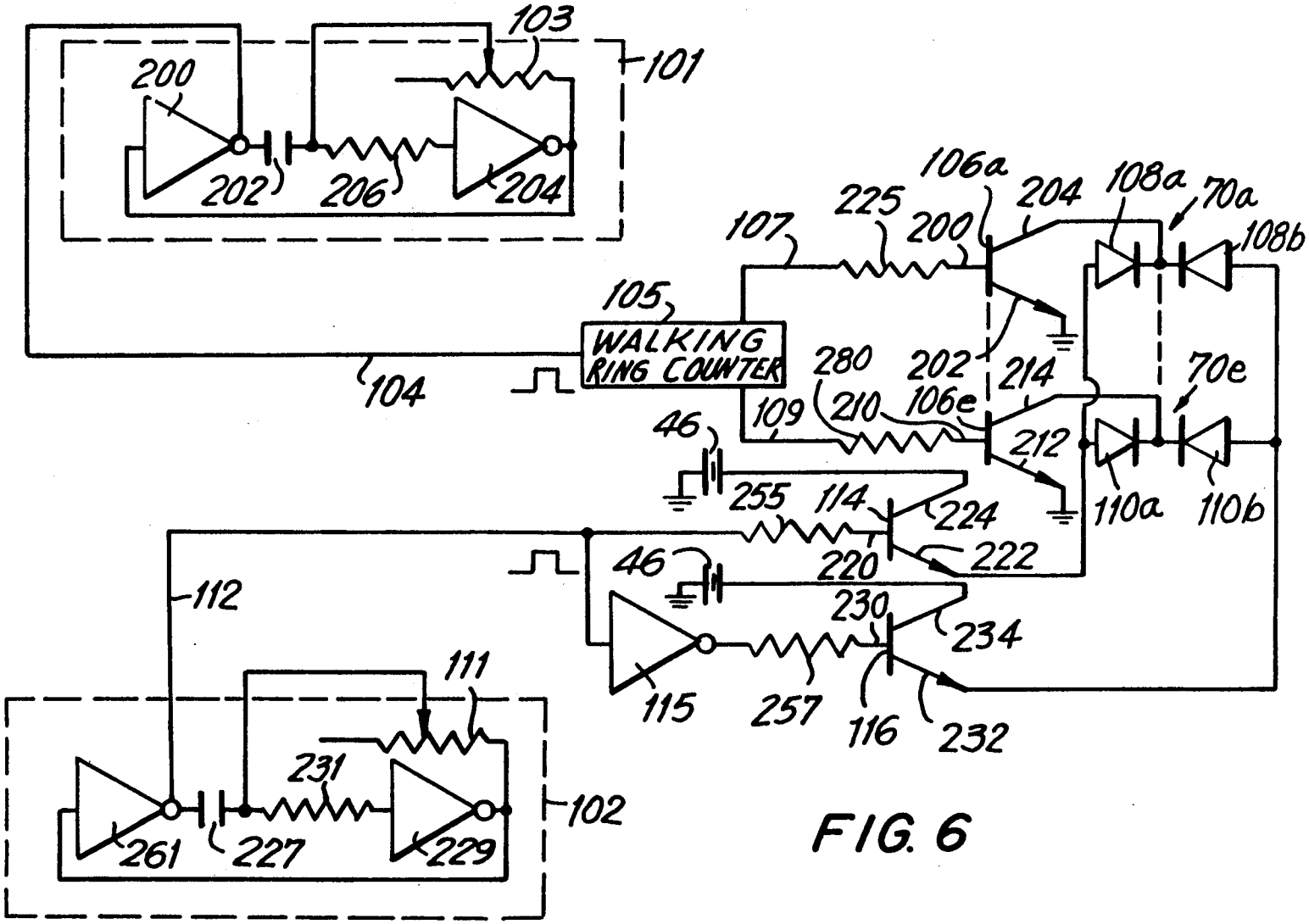
FIG. 6 is a circuit diagram of the circuitry of a first embodiment of the invention.

Reference is next made to FIG. 6, wherein a schematic diagram of the circuitry for an animated paddle constructed in accordance with a first embodiment of the invention is provided. This circuit drives LEDs 70a–70e in such a way that paddle 10 when rotated forms sequential rings of varying size such as a ring formed by LED 70a, followed by a ring formed by LED 70b, followed by a ring formed by LED 70c, etc.

An astable clock 101 includes a first inverter 200 which provides an output to capacitor 202. Capacitor 202 is coupled to a second inverter 204 through a resistor 206. Capacitor 202 also provides an input to inverter 200 through potentiometer 103, and inverter 204 provides a feedback input to inverter 200. Astable clock 101 outputs a clock pulse signal to a walking ring counter 105. Walking ring counter 105 includes a series of flip-flops such that the clock pulse triggers walking ring counter 105 to select a specific output from outputs 107 through 109 (only two of which are shown) and providing a high output at each output 107–109 in a predetermined pattern or sequence.

A first transistor 106a is coupled to an output 107 of walking ring counter 105 through a resistor 225. Transistor 78 is coupled at its collector to LED 78. As discussed above, LED 70a is in fact two LEDs 108a, 108b. Each LED pair 108a, 108b is joined at the respective cathode thereof and is coupled to the collector of transistor 106a at the joined cathodes of the diode pair. The emitter 202 of transistor 106a is grounded. As discussed above, in a preferred embodiment LED pair 108a, 108b emit different colored light from each other providing a two color LED 70a.

Similarly, an output 109 of walking ring counter 105 is provided to a transistor 106e through a resistor 280. Transistor 106e is coupled to LED 70e at the junction of the cathodes of LEDs 110a, 110b. Again, LED 70e is coupled to transistor 106e at a collector 214. The emitter of transistor 106e is grounded. LEDs 70b–70d are also coupled to walking ring counter 105 through respective transistors (not shown for ease of description).

The anode of each of LEDs 108a–110a is coupled to the emitter 222 of a transistor 114. The collector of transistor 114 is coupled to battery 46. Transistor 114 is coupled to a second astable clock 102 and receives a square wave output therefrom. The anode of each of LEDs 108b–110b is coupled to the emitter 232 of a transistor 116. The collector 234 of transistor 116 is coupled to battery 46. A base 230 of transistor 116 is coupled to astable clock 102 through an inverter 115 and resistor 257 so that transistor 116 receives the inverted signal input to transistor 114 so that the two operate out of phase.

Astable clock 102 also includes a first inverter 281 providing an input to capacitor 227. Capacitor 227 is coupled to a second inverter 229 through a resistor 231. Capacitor 227 then also provides an input to inverter 281 through a potentiometer 111. Potentiometers 103 and 111 are controlled by rotating switches 40, 42. Inverter 229 also provides a feedback input to inverter 281 which in response thereto outputs a square wave signal 112.

Astable clock 101 generates the driving pulse (clock pulse) for walking ring counter 105 which selects which LED 70a–70e is illuminated. Astable clock 102 generates the pulse for selecting which colored LED of each LED pair of LED 70a–70e is to be selected controlling the color of the ring being formed by rotation of the paddle. The color is changed between the red and blue colors of the LEDs.

Basic astable clock 101 provides a clock pulse or square wave input to the walking ring counter 105. However, any conventional square wave generator will provide the requisite signal. Clock signal 104 is output by astable clock 101 and it varies in frequency as the value of potentiometer 103 is varied.

The square wave input to walking ring counter 105 causes walking ring counter 105 to sequentially output a high signal to the base of transistors 106a–106e, respectively. Again, only two transistors 106*a* and 106*e* have been illustrated in FIG. 6. However, in the preferred embodiment, there is one transistor for each LED 70*a*–70*e*. Accordingly, in the preferred embodiment illustrated in FIG. 1, there are five (5) LEDs 70*a*–70*e* and five (5) transistors to drive the LEDs 70*a*–70*e*. The transistor used is a basic bipolar junction transistor (BJT).

When a high signal is generated at output 107 a high is fed through current limiting resistor 225 to the base 200 of BJT 106*a* allowing current to flow across emitter 202 and collector 204 essentially unimpeded (having approximately a normal voltage drop of 0.2 v). Therefore, the respective LED 70*a* is turned ON. As each respective BJT is turned on, the respective LED 70*b*–70*e* associated therewith will be turned ON if the anode of the selected LED is coupled to an ON transistor. Further, only one LED is turned ON at a time in this embodiment of the invention. Accordingly, when the signal at output 107 is high, the signal at output 109 is low. Therefore, the signal input at base 210 of transistor 106*e* is low. Thus, current cannot flow between emitter 212 and collector 214 of transistor 106*e*. Therefore, current does not flow through either diode 110*a* or 110*b*. As the clock pulse signal 104 changes, the flip-flops of walking ring counter 105 change and each consecutive transistor 106*a*–106*e* receives the high signal at its respective base, such that current can flow across emitter and collector, and the respective diode is turned ON.

Transistors 114, 116 provide color information for the diode. Basic astable clock 102 outputs signal 112 which is a clock pulse or square wave.

Inverter 281 outputs clock signal 112. The frequency of clock signal 112 is dependent upon potentiometer 111. As the resistance value of potentiometer 111 varies, so does the frequency of signal 112. When signal 112 is high, the high is fed through current limiting resistor 255 and base 220 of transistor 114 receives a high signal. Accordingly, transistor 114 is turned on and current may flow between emitter 222 and collector 224. Therefore, any one of LEDs 108*a*–110*a* will be turned ON if an open pathway is provided by a respective transistor 106*a*–106*e*. Simultaneously, the base 230 of transistor 116 receives a low signal when the base 220 of transistor 114 receives a high, because inverter 115 turns the high signal to a low signal. Accordingly, no current flows between emitter 232 and collector 234 of transistor 116. Therefore, diodes 108*b*–110*b* and those diodes in alignment with 108*b* and 110*b* will be turned OFF. This assures that diodes of the same color are illuminated together.

When signal 112 is low, the base 220 of transistor 114 is low. Accordingly, transistor 114 is turned OFF and the LEDs to which it is coupled are turned OFF. However, when signal 112 is low, inverter 115 converts the low signal to a high signal and the high is input through current limiting resistor 257 to the base 230 of transistor 116. Accordingly, transistor 116 is turned ON and the diodes connected thereto are capable of being turned ON by the appropriate transistors 106*a*–106*e*. For example, if transistor 116 is ON and transistor 106*a* is ON, a current path is provided from battery 46 through emitter 232 and through diode 108*b* to ground through transistor 106*a* illuminating diode 108*b*. If either transistor 106*a* or 116 is OFF then the pathway is broken and diode 108*b* will not be illuminated. Accordingly, transistors 114 and 116 simply provide color information. Either the red diodes, those in line with diodes 108*a* and 110*a* will illuminate, or the blue diodes, those in alignment with 108*b* and 110*b*.

A user may receive enhanced play value from an animated paddle by varying potentiometer 103 and potentiometer 111 which are illustrated in FIG. 2 as controls 40 and 42. These controls enable a user to vary the frequency with which the "ON" diode is switched, and the user is also able to vary the frequency with which the color of the diode is switched.

During operation, paddle 10 is turned ON, utilizing switch 44 coupling batteries 46 to LED 70*a*–70*e*. Astable clock 101 causes walking ring counter 105 to selectively illuminate LEDs 70*a*–70*e*. In the preferred embodiment, LEDs 70*a*–70*e* are sequentially illuminated in alphabetical order so that the light appears to move along upper portion 32 from bore 35*a* towards bore 35*e*. Simultaneously therewith, the output of astable clock 102 causes the color of the light emitted by the respective LED 70*a*–70*e* to change. As body 14 is rotated 360° relative to handle 28, the lights when viewed in top plan view appear to form a circle about handle 12. The light creates an illusion of circular designs which may be changed by the proper rotation speeds and control of the circuitry in the paddle. For example, each LED in sequence may illuminate for a complete rotation of the paddle. In other words, during a first rotation of the paddle, a large circle is formed and during each later rotation of the paddle, sequentially smaller circles are formed as the LED which is illuminated is changed. In the alternative, circles of varying sizes may appear randomly for each rotation of the paddle, or the number of circles that are formed during each rotation of the paddle may be varied. The switches on the side of the paddle body vary the created illusion. Further, the rate at which the light that is emitted by the paddle is varied between red and blue light may also be controlled. This in combination with the rotational speed of the paddle controls the illusion presented thereby.

Figure 7:
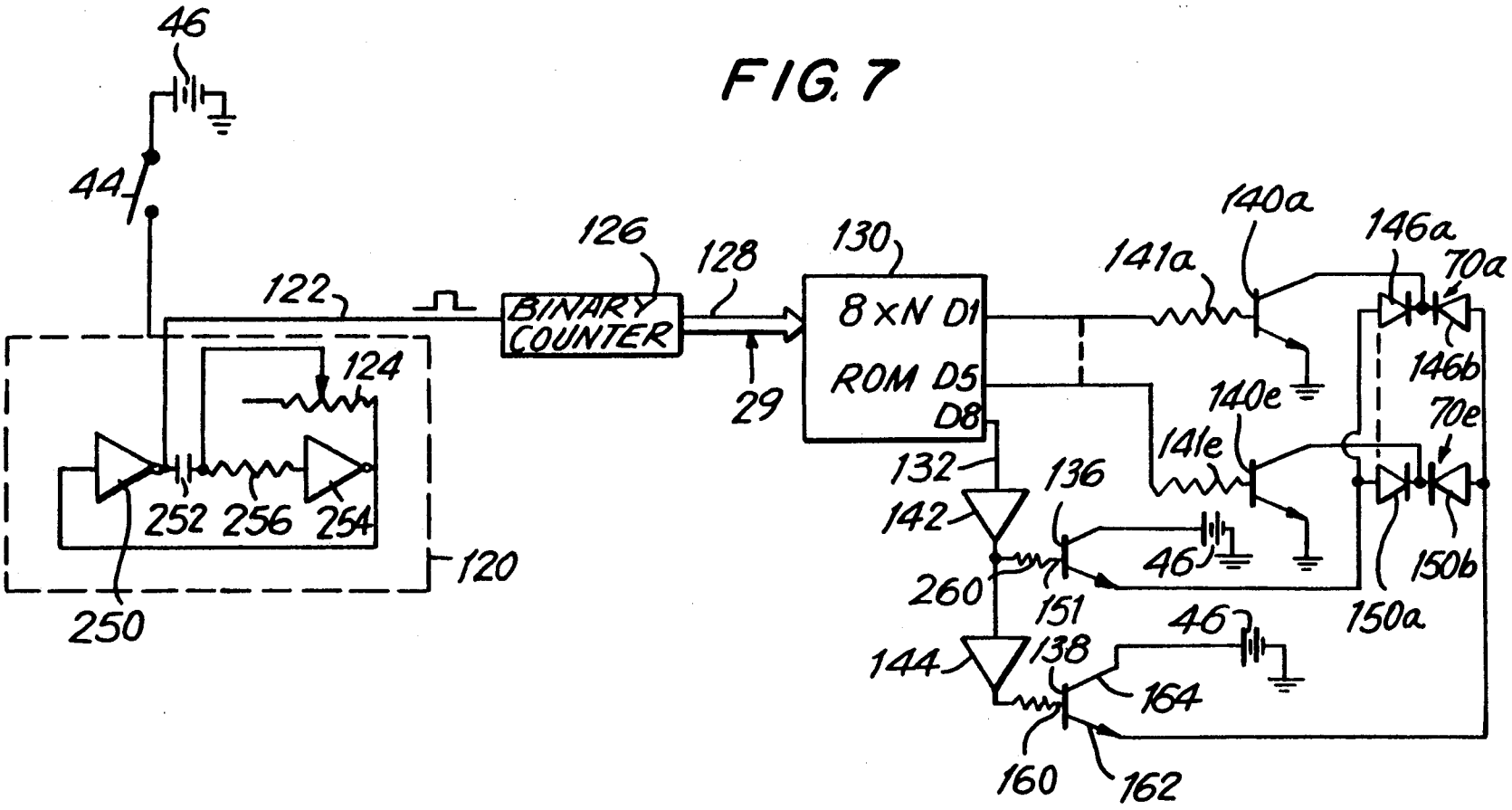
FIG. 7 is a circuit diagram of the circuitry of a second embodiment of the invention.

Reference is next had to FIGS. 3 and 7, wherein a circuit constructed in accordance with a second embodiment of the invention for causing paddle 10 to create messages when rotated is provided. The circuit includes a basic astable clock 120. Basic astable clock 120 provides a clock pulse output signal 122. Basic astable clock 120 includes a first inverter 250 coupled to a capacitor 252. Capacitor 252 is coupled to inverter 254 through a resistor 256. Capacitor 252 is also connected to the input of inverter 250 through a potentiometer 124, and inverter 254 provides a feedback input to inverter 250. Potentiometer 124 is varied to vary the frequency of clock pulse signal 122. Astable clock 120 is coupled to battery 46 through switch 44.

A binary counter 126 receives signal 122 and in response thereto provides an output signal 128 to ROM 130. ROM 130 is an eight by N ROM. ROM 130 stores lighting patterns for lighting LEDs 70*a*–70*e* in a variety of patterns either simultaneously, in subcombinations, or not at all. In response to instructions from binary counter 126, ROM 130 outputs instructions in parallel to a plurality of transistors 140*a*–140*e* through resistors 141*a*–141*e*. ROM 130 has five parallels outputs $D_1$–$D_5$. As in the first embodiment, transistors 140*a*–140*e*, of which only two are shown to facilitate discussion, are coupled to a respective LED 70*a*–70*e* of which only two are shown for ease of discussion. Again, LED 70*a* is formed by a diode pair 146*a*, 146*b* of differing colors coupled at the cathode which in turn is coupled to the collector of transistor 140*a*. Similarly, LED 70*e* is formed of a diode pair 150*a*, 150*b* coupled at the cathode which in turn is coupled to the collector of transistor 140*e*. Each of transistors 146*a*–150*a* are coupled at their respective anodes to the emitter of a transistor 136. The collector of transistor 136 is coupled to battery 46. Similarly, the anode of each respective diode 146*b*–150*b* is coupled to the emitter 162 of transistor 138. The collector of transistor 138 is also coupled to battery 46. An inverter 142 receives an input from the $D_8$ output of ROM 130 and provides an input to transistor 136 through resistor 260. An inverter 144 receives the output of inverter 142 and provides an input to transistor 138 through resistor 160 so that the inputs to transistors 136, 138 are always out of phase with respect to each other.

Clock pulse signal 122 is input to binary counter 126. Binary counter 126 counts in response to the clock pulse and outputs signal 128 to ROM 130. Signal 128 is actually a series of highs and lows input along a data bus 129 to ROM 130. ROM 130 accesses an appropriate address in memory corresponding to the desired light pattern in response to signal 128. Each address in memory stores appropriate data corresponding to a different segment of the entire pattern to be output. Signals corresponding to the pattern are output at $D_1$ through $D_5$.

For example, if the desired effect is to produce the letter "I", then the address in memory indicated by signal 128, would cause ROM 130 to output high signals at $D_1$ and $D_5$ so that transistor 140*a* and 140*e* would receive high signals at their base and low signals at $D_2$–$D_4$. This causes top diode 70*a* of paddle 10 and the bottom diode 70*e* of paddle 10 to first be turned ON as seen in phantom (FIG. 3). Secondly, ROM 130 would output high signals at $D_1$ through $D_5$ so that transistors 140*a* through 140*e* would be turned ON so that all the respective diodes 70*a*–70*e* would be turned ON forming the middle of the "I". Lastly, to complete the "I" ROM 130 would again output high signals at outputs $D_1$ and $D_5$ and lows at $D_2$–$D_4$. This again causes LEDs 70*a*, 70*c* to be lit completing the "I". The remaining letters of the word "CIRCUS" shown in FIG. 3 are formed in the same manner.

Transistors 140*a*–140*e* operate similarly to transistors 106*a*–106*e* of FIG. 6. When the base of transistors 140*a*–140*e* receive a high signal, they are turned ON permitting current to flow between emitter and collector. Accordingly, the diode connected with that transistor becomes illuminated if the pathway is completed by either transistor 136 or transistor 138.

Output $D_8$ of ROM 130 transmits the color information to respective LEDs 70*a*–70*e*. When signal 132 from output $D_8$ is high, inverter 142 turns the high to a low. Accordingly, the base 151 of transistor 136 receives a low signal. Therefore, transistor 136 is OFF. However, when the signal output by inverter 142 is low, inverter 144 converts the signal to a high and the base 160 of transistor 138 receives a high signal. Accordingly, transistor 138 is turned ON and current flows between emitter 162 and collector 164. Therefore, diodes 146*b*–150*b* which are electrically connected to the emitter 162 of transistor 138 are in condition for illumination and become illuminated if they are electrically connected to a transistor 140*a*–140*e* that is ON. Alternatively, if output $D_8$ of ROM 130 is low, a high is sent through current limiting resistor 260 and transistor 136 is turned ON and diodes 146*a*–150*a* are in condition for illumination.

Battery 270 is depicted as being coupled to the circuit at astable clock 120 through ON/OFF switch 44. If ON/OFF switch 44 is an open circuit, then astable clock 120 does not operate and no diodes will illuminate (the circuit is OFF). However, if switch 44 is closed (a short circuit), astable 120 is operational and the appropriate diodes illuminate.

Reference is next made to FIG. 3, wherein a top plan view of paddle 10 is depicted in use with phantom paddles shown in a three hundred sixty degree (360°) rotation around handle 12. The illusion of a word appearing is made possible due to the flash rate of LEDs 70*a*–70*e* and the retinal retention of the eye. The human eye is capable of spotting a flash of light that is illuminated for just a fraction of a second. Light which flashes at greater than 18 Hz is retained by the eye so that when a number of flashes forming a word occurs, it appears that the entire word is spelled out about the handles by the series of flashes.

FIG. 3 illustrates numerous pertinent instances of illumination of lights 70*a*–*e*. It depicts the lights in phantom at positions where they would be in the illuminated state. For example, in the case of the letter "S" 72, LED's 70*a*, 70*c* and 70*e* are illuminated in the phantom paddle 10 and four (4) more positions of LED's 70*a*, 70*c* and 70*e* are illuminated forming the cross bars of the "S" in space as paddle 10 is rotated. In this case, 70*a* might maintain its illuminated state for the entire swing of the top portion of the "S", rather than flashing ON and OFF. Light 70*b* is in the ON condition initially as shown in phantom paddle 75 to form the top curve of the "S". However, light 70*b* turns OFF to form the bottom curve of the "S" as shown by the absence of a dot farther along the circle in the direction of arrows B. Accordingly, a person viewing the paddle would be able to read the word "CIRCUS", when, in fact, there are a maximum of five (5) LEDs that can be illuminated at any point in time. As stated hereinabove, the illusion of the word "CIRCUS" being illuminated at any point in time is due to the retinal retention of the eye.

It can be seen that depending upon the information stored in ROM 130 different effects are exhibited by diodes 70*a*–70*e*. Further, depending upon the value of potentiometer 124 controlled by either switch 40 or 42, the frequency of clock signal 122 varies, and the frequency with which the message being transmitted through the LEDs 70*a*–70*e* varies. Thus, if astable clock 120 produces a high frequency signal 122, the message may appear two times or more in one rotation of the paddle. On the other hand, when clock signal 122 has a low frequency, the message may only appear once per rotation of the paddle. Further, the color illuminated by the diode is preprogrammed into ROM 130. Accordingly, as the frequency of clock signal 122 increases, the color changes increase.

Further, it is noted that using controls 42, the word "CIRCUS" can appear one or more times in any 360° swing of the paddle, or can appear to move around the paddle as the paddle swings. Accordingly, a creative user may create many different illusions from the paddle, for example, forming one word, repeating the one word multiple times during a swing, and making the word appear to move during the rotation of the paddle.

The instant invention is characterized by an animated paddle that is capable of producing several distinct types of play value. In a first embodiment, a multiplicity of different size and colored circles or line segments are produced when the illuminated paddle is rotated. By varying the speed with which the paddle is rotated, along with varying the frequency of oscillation of the astable clocks, which is accomplished through external controls, varied designs in light are produced. In a second embodiment, a paddle is rotated about the handle and a message or picture is produced in accordance with information stored in a ROM chip. This also may be varied by controlling the speed at which the paddle is rotated and by varying the frequency of the astable clock using external controls. Both these embodiments also provide varying colors and noise making capability to enhance the play value for the user.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An animated paddle comprising a handle oriented in an axial direction and a body rotationally mounted about said handle, a light source means disposed on said paddle body for emitting light in at least a direction substantially parallel to said axial direction and light source energizing means for selectively lighting said light source means for producing a variable sequence of first predetermined light patterns, so that rotation of said body about said handle produces a lighted image comprised of an aggregate of the lighting sequences of said first predetermined light patterns being displayed at least in a plane substantially perpendicular to said axial direction.

2. The animated paddle of claim 1, wherein said light source energizing means includes a ROM, said first predetermined pattern being stored in said ROM.

3. The animated paddle of claim 1, wherein said light source means includes a plurality of light sources each light source including at least one light emitting diode.

4. The animated paddle of claim 3, wherein said light emitting diode selectively emits a light of at least two colors.

5. The animated paddle of claim 1, wherein said lighted image is a word.

6. The animated paddle of claim 2, further comprising a binary counter, each of said first predetermined patterns being stored at an address in said ROM, said binary counter selecting said address in the ROM.

7. The animated paddle of claim 6, further comprising frequency control means to control the frequency with which said binary counter selects said address in the ROM.

8. The animated paddle of claim 1, wherein said lighted image is formed of a plurality of pattern segments, each first predetermined pattern being a pattern segment.

9. The animated paddle of claim 1, wherein said energizing means includes a walking ring counter.

10. The animated paddle of claim 9, wherein the walking ring counter varies said lighted image in response to a clock pulse.

11. The animated paddle of claim 4, wherein said lighted image is formed of a plurality of pattern segments, each first predetermined pattern being a pattern segment.

12. The animated paddle of claim 1, wherein said handle is formed with a ball and said body being formed with a socket adapted to receive said ball.

* * * * *